US006427391B1

(12) United States Patent
Lyons

(10) Patent No.: US 6,427,391 B1
(45) Date of Patent: Aug. 6, 2002

(54) METHODS AND APPARATUS FOR ATTACHING A CANTILEVERED BEAM TO A BUILDING

(76) Inventor: Martin G. Lyons, 9100 E. Marginal Wy., Seattle, WA (US) 98108-4028

( * ) Notice: Subject to any disclaimer, the term of this patent is extended or adjusted under 35 U.S.C. 154(b) by 0 days.

(21) Appl. No.: 09/425,725

(22) Filed: Oct. 22, 1999

(51) Int. Cl.[7] ..... E04B 1/34

(52) U.S. Cl. ..... 52/73; 52/236.6; 52/289

(58) Field of Search ..... 52/73, 236.7, 236.9, 52/236.3, 236.6, 289, 745.21, 745.05, 745.13

(56) References Cited

U.S. PATENT DOCUMENTS

| | | | | | |
|---|---|---|---|---|---|
| 665,533 | A | | 1/1901 | Kuhl | |
| 1,858,701 | A | * | 5/1932 | Boettcher | 52/289 X |
| 3,370,388 | A | * | 2/1968 | Dielman | 52/73 |
| 3,505,768 | A | * | 4/1970 | Bentley | 52/236.3 X |
| 3,652,046 | A | * | 3/1972 | Hughes | 52/73 X |
| 3,815,300 | A | * | 6/1974 | Bain | 52/73 |
| 4,457,115 | A | * | 7/1984 | Grearson et al. | 52/73 |
| 4,548,003 | A | | 10/1985 | Johansson et al. | 52/73 |
| 4,811,542 | A | * | 3/1989 | Jewell | 52/745.05 X |
| 4,854,549 | A | | 8/1989 | Roberts et al. | 256/69 |
| 5,242,239 | A | | 9/1993 | Hosokawa | 403/258 |
| 5,711,122 | A | | 1/1998 | Lee | 52/283 |
| 5,720,571 | A | | 2/1998 | Frobosilo et al. | 403/403 |
| 5,761,863 | A | | 6/1998 | Sutt, Jr. et al. | 52/272 |
| 5,813,175 | A | * | 9/1998 | Hiragaki | 52/236.6 X |
| 5,826,386 | A | * | 10/1998 | Casteel | 52/73 X |
| 5,881,516 | A | * | 3/1999 | Luedtke | 52/236.3 |
| 6,131,358 | A | * | 10/2000 | Wise | 52/289 X |
| 6,219,989 | B1 | * | 4/2001 | Tumura | 52/745.21 X |

* cited by examiner

*Primary Examiner*—Peter M. Cuomo
*Assistant Examiner*—Stephen Vu
(74) *Attorney, Agent, or Firm*—Fleshner & Kim, LLP

(57) ABSTRACT

A device and method for mounting an exterior cantilevered beam to a building holds the exterior cantilevered beam away from the building and provides superior waterproofing. In some embodiments, a strap member is used to spread loading forces onto interior building support members that are arranged perpendicular to an exterior wall of the building. In other embodiments of the invention, mounting members that include necks extending through exterior walls and away from the walls are used to mount an exterior cantilevered beam to the building, and to keep the exterior beam supported away from the exterior wall.

26 Claims, 6 Drawing Sheets

METHODS AND APPARATUS FOR ATTACHING A CANTILEVERED BEAM TO A BUILDING

BACKGROUND OF THE INVENTION

1. Field of the Invention

The invention is directed to methods and apparatus for attaching an exterior cantilevered beam to a building.

2. Background of the Related Art

FIG. 1 shows a deck 50 attached to an exterior wall 40 of a building. The deck 50 includes cantilevered supporting beams 54, and a handrailing 56. The most common way to attach the deck 50 to the exterior wall 40 of the building, is to first attach a support plate 52 to the exterior wall 40 of the building. The support plate 52 can be attached to the exterior wall 40 using lag bolts, nails, or other suitable methods. Typically, the support plate 52 is simply attached to an interior support beam 58, such a rim-joist or floor-joist.

The weight of the deck itself, and the weight of any articles or people that are placed on the deck 50 create a force $F_1$ which pushes the deck downward. Because the left end of the deck is attached to the building, the force $F_1$ also creates a rotational moment M. The moment M results in the support beams 54 applying separate and opposed forces to the support plate 52. A first force F2 pushes in at the bottom of the support plate 52, and a second force F3 pulls the support plate 52 away from the wall of the building 40.

Because the support plate 52 on the exterior of the building is attached to the support member 58 inside the building, the two forces F2 and F3 tend to rotate the exterior support plate 52 and the interior support member 58. This can cause warping, and stresses that adversely affect the exterior wall 40 and any interior floor that rests on the interior support member 58.

In addition, because the support plate 52 is directly attached to the exterior wall 40 of the building, small gaps between the exterior wall 40 and the support plate 52 can hold water or moisture for long periods of time. Any fasteners used to attach the exterior support plate 52 to the exterior wall 40 of the building can provide a pathway that allows water and moisture to pass into the building 40. The moisture that collects between the support plate 52 and the exterior wall 40, and any moisture that passes into the building, can cause rotting, and other negative consequences which adversely affect the structural integrity of the building.

SUMMARY OF THE INVENTION

Devices and methods embodying the present invention are intended to overcome one or more of the disadvantages of prior art methods for attaching a deck or balcony to an exterior of building.

Devices and methods embodying the invention spread the loading forces applied to interior support members of a building by an exterior deck or balcony to those interior support members that are best able to withstand the forces.

Methods and devices embodying the invention can also improve the waterproof integrity of the exterior wall of the building at the point where a deck or balcony is attached to the exterior wall.

In addition, devices and methods embodying the invention result in an exterior deck or balcony being held a small distance away from an exterior wall of the building such that water and moisture will not collect in apertures formed between the deck or balcony and the exterior wall of the building.

A mount embodying the invention, for attaching an exterior cantilevered beam to a building, may include upper and lower bolts that pass through an exterior wall of the building, and through a first interior support member having a length axis that is arranged substantially parallel to the exterior wall of the building. Ends of the upper and lower bolts that penetrate the exterior wall and extend beyond the wall are configured to be attached an exterior cantilevered beam. The mount also includes a strap that is attached to the upper bolt and to a second interior support member having a length axis that runs substantially perpendicular to the exterior wall of the building.

A second embodiment of the present invention may include a mounting member having a flat base, a neck that extends from the flat base, and a substantially straight bore that passes through the neck and the flat base. The flat base of the mounting member is configured to be attached to an interior support member of a building such that the neck of the mounting member extends through a hole in an exterior wall of the building. A screw can then be used to attach an exterior cantilevered beam to the mounting member. The screw would pass through the bore of the mounting member and into the interior support member. The screw may include threads that cooperate with threads formed on an interior bore of the mounting member.

A method, embodying the invention, for creating a mount for an exterior cantilevered beam, may include the steps of creating upper and lower holes that extend through an exterior wall of a building, and through a first interior support member having a length axis that is substantially parallel to the exterior wall. The method would also include a step of attaching a strap to a second interior support member having a length axis that is arranged substantially perpendicular to the exterior wall. Next, an upper bolt would be inserted through the upper hole, and through a hole in the strap. A lower bolt would be inserted through the lower hole. A plurality of nuts would then be threaded onto the upper and lower bolts. An exterior cantilevered beam could then be attached to ends of the upper and lower bolts that extend through the exterior wall.

A second method, embodying the invention, for forming a mount includes the steps of: forming a hole through an exterior wall of a building, attaching a mounting member to an interior support member, and providing a screw that is configured to be attached to the mounting member. In this method, the mounting member would include a flat base, a neck that extends from the flat base, and a substantially straight bore that passes through the neck and through the flat base. In some embodiments, the screw may have threads that are intended to connect with threads formed on an interior of the bore. In other embodiments, the screw may pass completely through the bore, and the threads may attach to an interior support member behind the mounting member. In still other embodiments, the threads may connect with both threads on the bore and with the interior support member.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

Preferred embodiments of the invention will be described in conjunction with the following drawing figures, wherein like elements are referred to with like reference numbers, and wherein.

DETAILED DESCRIPTION OF PREFERRED EMBODIMENTS

For purposes of the following description, and in the claims, the term "bolt" is used to refer to an item that is used to hold two items together. This term should be interpreted to cover any type of fixation device that performs the function of a typical bolt.

Figure 1:
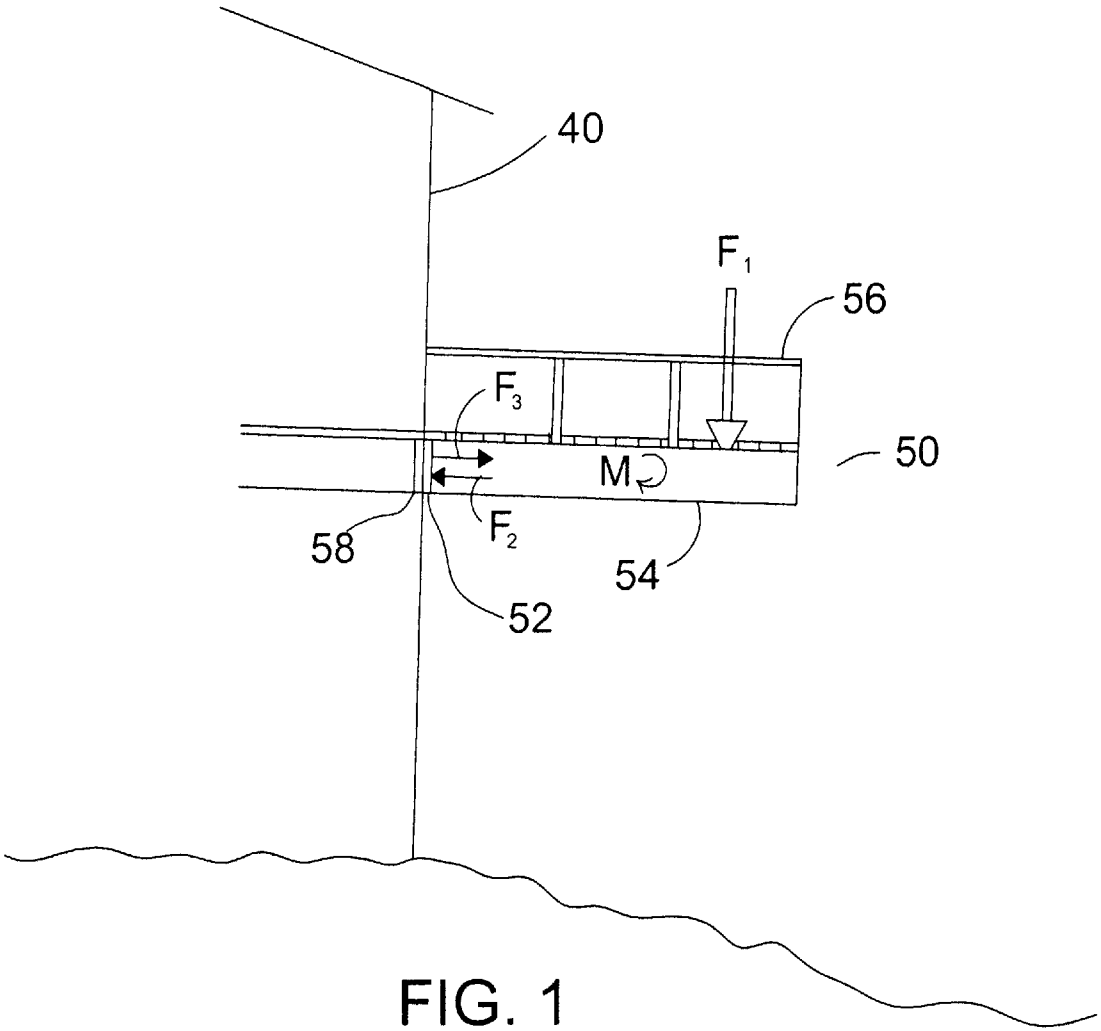
FIG. 1 (PRIOR ART)
FIG. 1 is an elevation view showing a deck attached to an exterior of a building.
Figure 2:
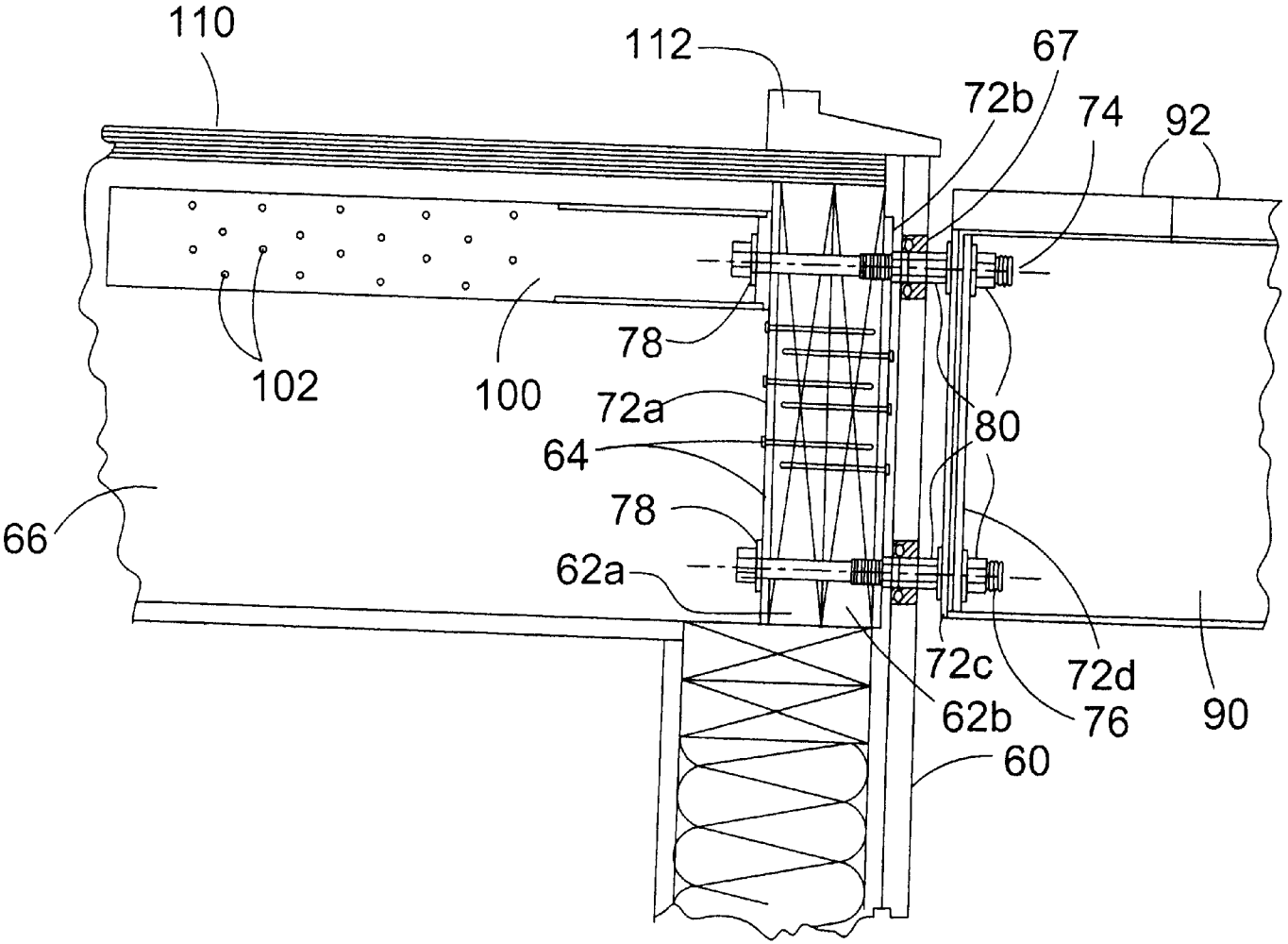
FIG. 2 is an elevation view showing mounting details for a first embodiment of the invention.
Figure 3:
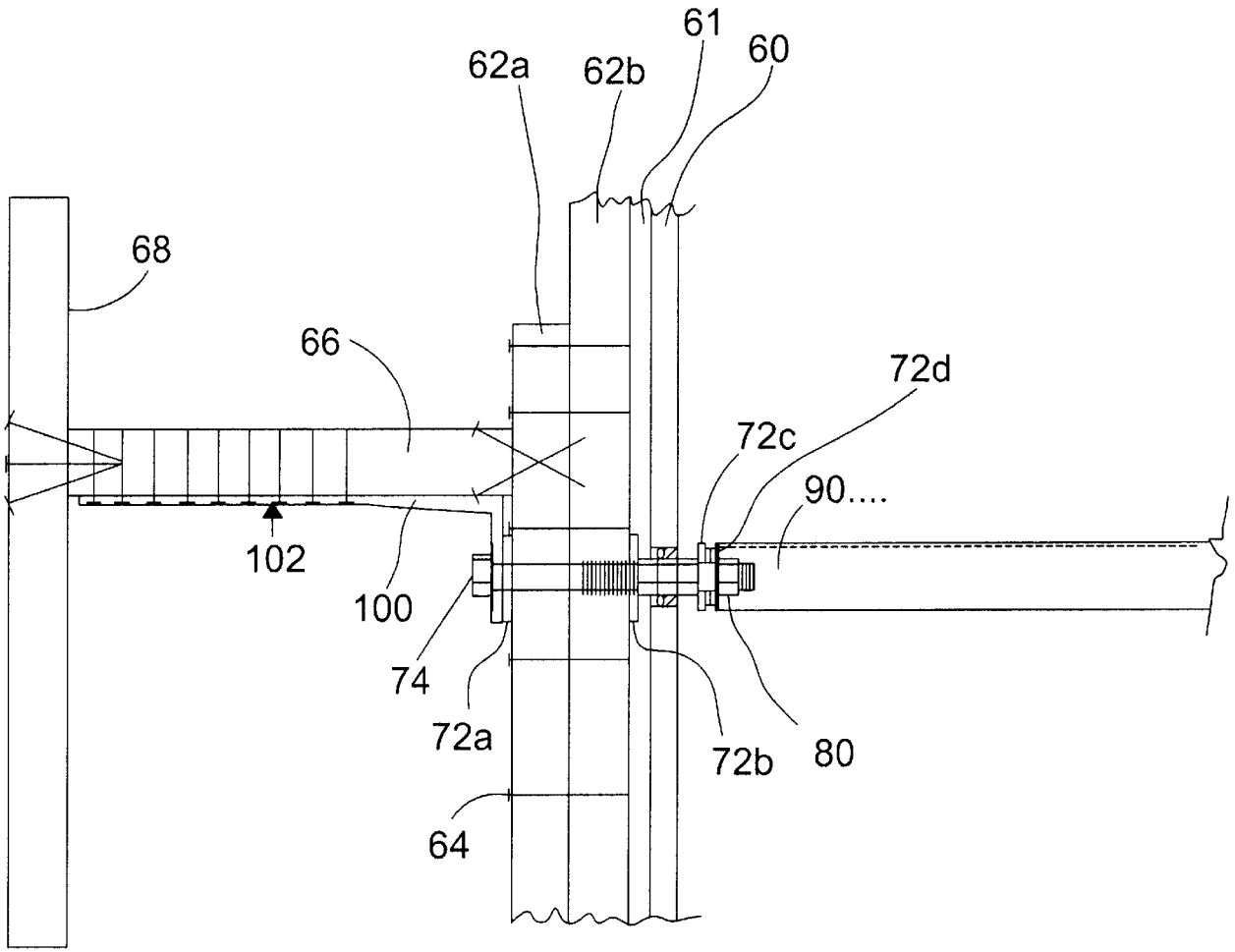
FIG. 3 is a plan view of the first embodiment of the invention.

The first mounting system embodying the invention is shown in FIGS. 2 and 3. The mounting system is used to attach an exterior cantilevered beam to an exterior side of a building. The exterior cantilevered beam could be used as a structural member of a outdoor deck or balcony, or for other structural purposes.

In the elevation view shown in FIG. 2, an exterior cantilevered beam 90 is attached to an exterior of a building. The mounting system passes through a first interior support member 62*a*–62*b*, as well as exterior wall 60 of the building. The first interior support member 62*a*–62*b* is used with a second interior support member 66 to support an interior floor 110 of the building. A threshold 112 is located in a doorway which opens onto an outdoor deck 92 formed on the exterior cantilevered beam 90.

The exterior cantilevered beam 90 is attached to an upper bolt 74 and a lower bolt 76. The ends of the upper and lower bolts 74, 76 protrude from the exterior wall 60 of the building. The upper and lower bolts 74, 76 are attached to the first interior support member 62*a*–62*b*. In addition, the upper bolt 74 is also attached to the second interior support member 66.

The first interior support member includes a first board 62*a* and a second board 62*b*. These boards can be interior rim-joists, or normal floor-joists. Although the embodiment shown in FIG. 2 includes two boards, in other embodiments, only a single interior rim-joist 62*b* might be present. In embodiments like the one shown in FIG. 2, the second board 62*a* could be a part of the structural support system for the floor 110, or the second board 62*a* could be added at the time the mounting bolts are installed. The use of the second mounting board 62*a* would provide increased rigidity and structural integrity to the mounting system. In still other embodiments, a third support beam that runs parallel to the two boards 62*a*–62*b*, could be added for even more increased structural rigidity. In any event, in the embodiment shown in FIGS. 2 and 3, the two boards together form a first interior support member 62*a*–62*b*. The first interior support member 62*a*–62*b* has a longitudinal axis that is arranged parallel to the exterior wall 60 of the building.

The second interior support member 66 has a longitudinal axis that runs perpendicular to the exterior wall 60 of the building. The second interior support member 66 could be a normal floor joist used to support the interior floor 110 of the building. In other embodiments, like the one shown in FIG. 3, the second interior support member 66 could be a board bridging two interior floor joists. In the embodiment shown in FIG. 3, the second interior support member 66 is simply a board which is attached between a first floor joist 62*b*, which is actually a rim joist, and a second floor joist 68.

An L-shaped strap member 100 is attached to the second interior support member 66. The L-shaped strap member 100 includes a first, long leg which is arranged along the second interior support member 66. A plurality of nails 102 are used to attach the L-shaped strap member 100 to the second interior support member 66. A short leg of the L-shaped strap member 100 lies along the first interior support member 62*a*–62*b*. A hole is formed through the short leg of the L-shaped strap member 100. The upper bolt 74 passes through the hole in the short leg in the L-shaped strap member 100, then through a hole in the first interior support member 62*a*–62*b*, and then through a hole in the exterior wall 60. The end of the bolt 74 protrudes from the exterior wall 60. Similarly, the lower bolt 76 passes through a hole in the first interior support member 62*a*–62*b*, and through a hole in the exterior wall 60. The end of the lower bolt 76 also protrudes from the exterior wall 60.

In the embodiment shown in FIGS. 2 and 3, a first flange 72*a* is positioned between the heads of the bolts 74, 76 and an interior side of the first interior support member 62*a*–62*b*. A second flange 72*b* is positioned on the outer side of the first interior support member 62*a*–62*b*. The upper bolt 74 and the lower bolt 76 pass through holes in the first and second flanges 72*a*, 72*b*. Nuts 80 are threaded onto the upper and lower bolts 74, 76 and the nuts adjacent the second flange 72*b* served to sandwich the first interior support member 62*a*–62*b* between the first flange 72*a* and the second flange 72*b*.

Additional nuts may be threaded onto the upper and lower bolts 74, 76 such that the additional nuts extend from the second flange 72*b* through the exterior wall 60. In the embodiment shown in FIG. 2, the third nut 80 on each of the upper and lower bolts 74, 76 forms a bearing surface which will hold the exterior cantilevered beam 90 away from the exterior wall 60.

A third flange 72*c* and a fourth flange 72*d* are then sandwiched on either side of the end plate of the exterior cantilevered beam 90. Additional nuts 80 are threaded onto the ends of the upper and lower bolts 74, 76 to trap the cantilevered beam 90 between the third and fourth flanges 72*c*, 72*d*. As a result, the exterior cantilevered beam 90 is held away from the exterior wall 60.

As mentioned above, weight placed on the exterior cantilevered beam 90 tends to cause a first force which would press the bottom of the exterior cantilevered beam against the exterior wall 60. Thus, the cantilevered beam 90 tends to push the lower bolt 76 into the building. In addition, a second force tends to pull the top of the exterior cantilevered beam 90 away from the exterior wall 60. Thus, the cantilevered beam tends to pull the upper bolt 74 away from the building.

Because the upper bolt 74 is attached to the L-shaped strap member 100, the force applied to the upper bolt 74 by the exterior cantilevered beam 90 will be spread to the second interior support member 66, which has a longitudinal axis that is arranged perpendicular to the exterior wall. This helps to better spread the forces applied by the exterior cantilevered beam 90 among the interior support members so that the first interior support member 62*a*–62*b* is less likely to be twisted or warped out of position.

In addition, because the exterior cantilevered beam 90 is held away from the exterior wall 60, an air gap will exist between the exterior wall 60 and any deck or balcony that is formed on top of the exterior cantilevered beam 90. This helps to prevent the collection of moisture against the exterior wall 60, which prevents rot or mildew from occurring in the exterior wall 60. Further, a waterproofing material, such as a caulk 67, may be placed in the holes passing through the exterior wall 60 and around the upper and lower bolts 74, 76. The caulking material 67 helps to prevent water or moisture from entering the building through the holes penetrating the exterior wall 60.

Figure 4:
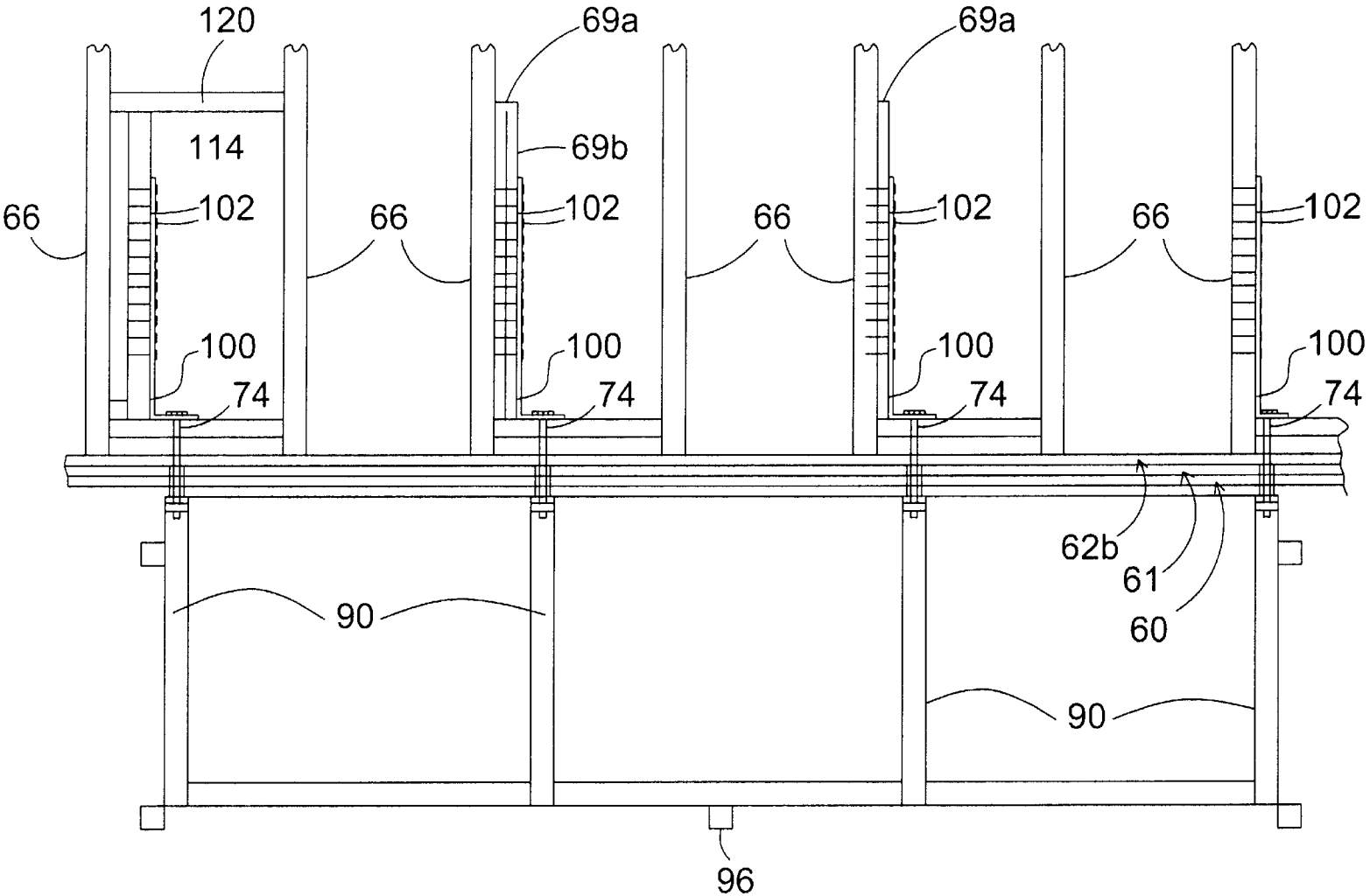
FIG. 4 is a plan view showing how support members for an exterior balcony may be connected to a building using embodiments of the invention.

A plan view of several different exterior cantilevered beams 90 attached to an exterior wall 60 of the building is shown in FIG. 4. In the arrangement shown in FIG. 4, a plurality of floor joists 66 are located in the interior of the building, and a longitudinal axis of each of the floor joists 66 is arranged perpendicular to the exterior wall 60. A rim joist 62*b* runs along the interior of the wall 60. The wall of the building can include a sheath or insulation layer 61, as well as an exterior finish layer 60, such as stucco or siding.

In the arrangement shown in FIG. 4, four exterior cantilevered beams 90 are connected to additional beams 94 to form the basis of an exterior deck. In addition, upright support posts 96 can be attached to the exterior cantilevered beams 90, or the additional support members 94. The upright support posts 96 can be used to create a hand railing. Planking or other types of decking material can be attached to the cantilevered beams 90 and the additional beams 94 to create the floor of the deck or balcony.

An L-shaped strap member 100 is attached to the upper bolts holding each of the exterior cantilevered beams 90 to the building. The long-legs of the L-shaped strap members 100 are then attached to an interior support member having a length axis arranged perpendicular to the exterior wall. However, as shown in FIG. 4, the exterior cantilevered beams 90 do not always align with floor joists that have a length axis that is perpendicular to the exterior wall. For this reason, it may necessary to add additional interior support members to the existing floor joists so that the L-shaped strap members 100 can be properly connected.

In the arrangement shown in FIG. 4, the rightmost exterior cantilevered beam 90 is aligned with a floor joist 66 having a length axis that is perpendicular to the exterior wall 60. An L-shaped strap member 100 is nailed to the interior floor joist 66 with a plurality of nails 102. A bolt then passes through the short leg of the L-shaped strap member 100 and the end of the bolt is connected to the exterior cantilevered beam 90.

In the case of the exterior cantilevered beam 90 second from the right, the exterior cantilevered beam 90 is not properly aligned with an interior floor joist 66. For this reason, it is necessary to add an additional board 69*a* on one side of the interior floor joist 66 so that the L-shaped strap member 100 can be properly aligned with the end of the exterior cantilevered beam 90. The long leg of the L-shaped strap member 100 is then nailed to both the interior floor joist 66 and the first board 69*a*. A bolt passes through the short leg of the L-shaped strap member 100 and the end of the bolt is attached to the exterior cantilevered beam 90.

In the case of the exterior cantilevered beam 90 second from the left, two additional boards 69*a*, 69*b* must be attached to an interior floor joist 66 so that the L-shaped strap member 100 can be properly aligned with an end of the exterior cantilevered beam 90.

In the case of the left-most exterior cantilevered beam 90, the exterior cantilevered beam 90 is even further offset from any of the existing interior floor joists 66. In this instance, a bridge member 120 is first attached between adjacent interior floor joists 66. A support member 114 is then attached between the bridge member 120 and the rim joist 62*b*. The long leg of the L-shaped strap member 100 is then nailed to the support member 114 with a plurality of nails 102. This allows the exterior cantilevered beam 90 to be mounted to the L-shaped strap member 100 with an upper bolt 74, even though the exterior cantilevered beam 90 is located between two interior floor joists 66.

Figure 5A:
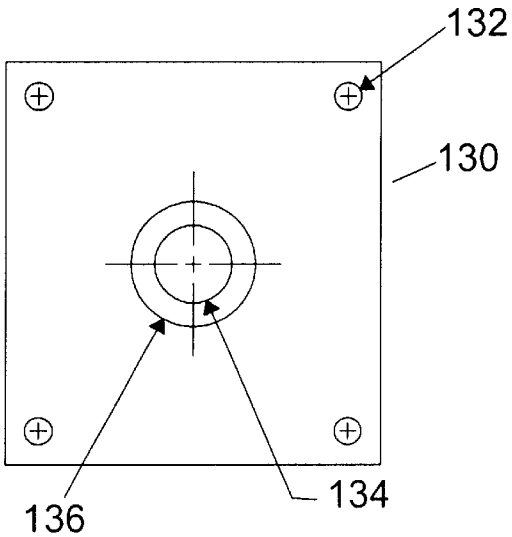
FIGS. 5A and 5B are top and front views of a mounting member embodying the invention.
Figure 5B:
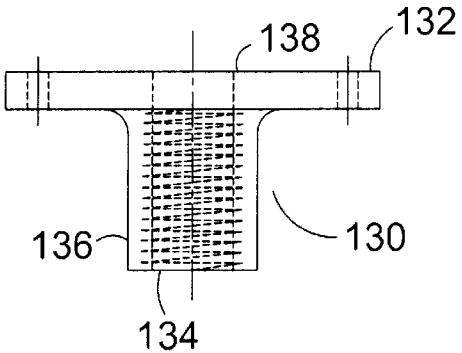

A second device and method for attaching an exterior cantilevered beam to a building is done with the support member shown in FIGS. 5A and 5B. As shown in these figures, the support member 130 includes a flat base 138. In the embodiment shown in FIGS. 5A and 5B, the flat base 138 is square. However, the flat base 138 could also be round, or have other shapes.

A plurality of apertures 132 pass through the flat base 138. The apertures 132 are configured to allow fasteners to pass therethrough so that the support member can be attached to a support member of a building. A neck 136 is formed on the support member 130, the neck extending away from the flat base 138. A bore 134 passes down through the center of the neck 136, and through the flat base 138. The interior of the bore 134 may be threaded.

Figure 6:
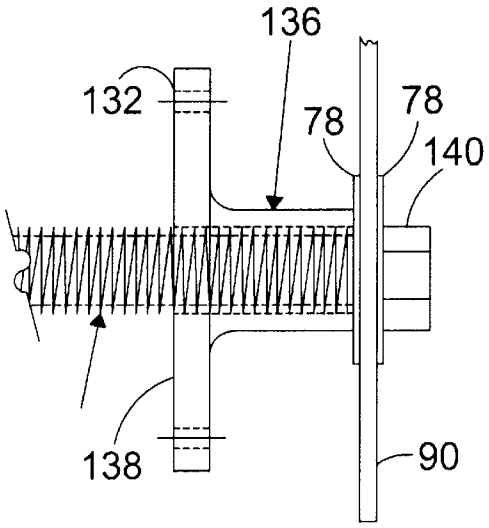
FIG. 6 is a side view of a mounting member embodying the invention attached to a beam.

FIG. 6 shows an end flange of an exterior cantilevered beam 90 attached to the top of the neck 136 of a mounting member 130. The end of exterior cantilevered beam 90 is sandwiched between two washers or flanges 78. A bolt 140 passes through the washers or flanges 78, the exterior cantilevered beam 90 and into the bore 134 of the mounting member 130. Threads on the bolt 140 cooperate with the threads on the inside of the bore 134 to firmly hold the exterior cantilevered beam 90 against the end of the neck 136.

Figure 7:
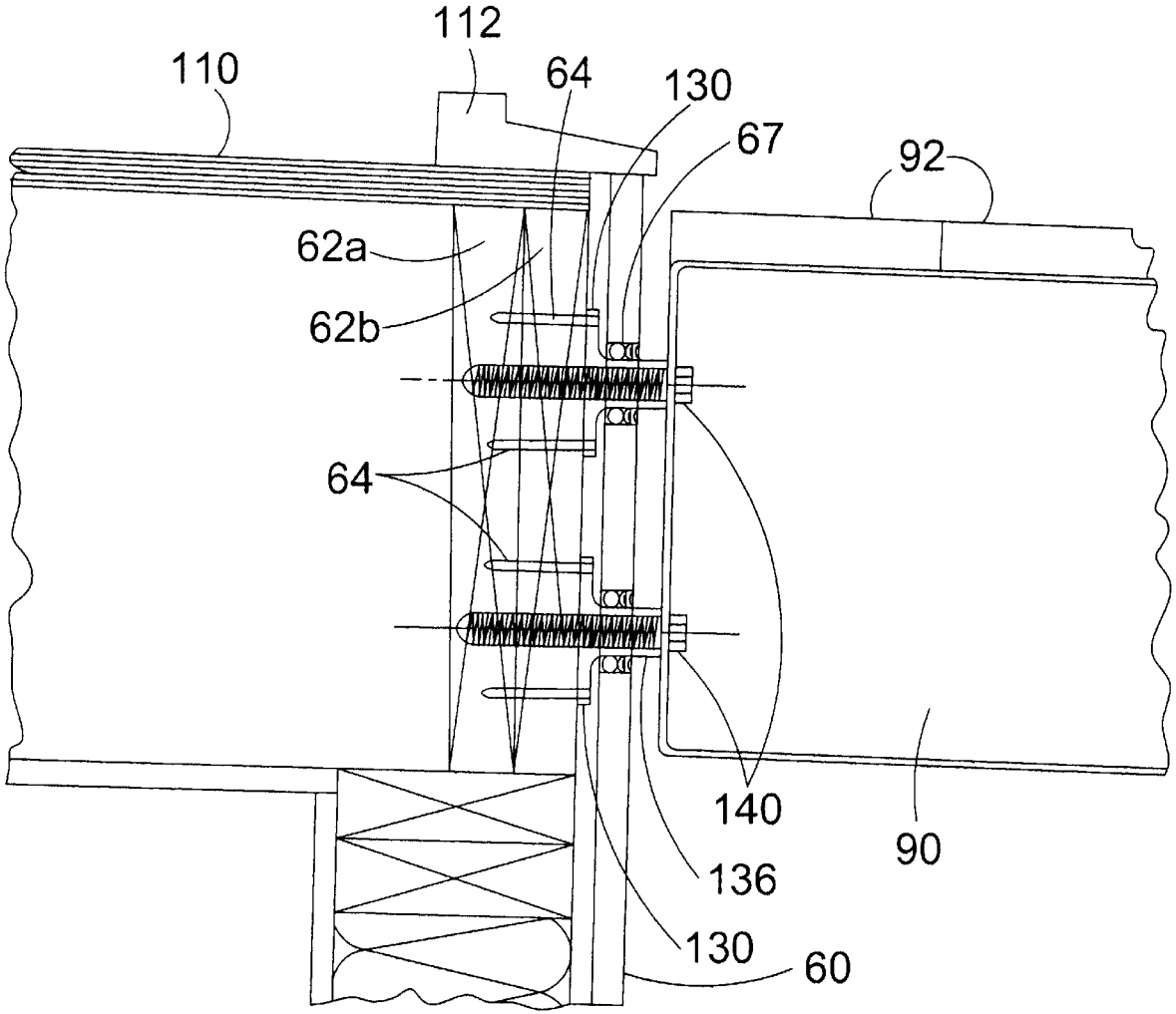
FIG. 7 is an elevation view showing an additional embodiment of the invention.

A mounting arrangement using two mounting members 130 to attach an exterior cantilevered beam 90 to an exterior of a building is shown in FIG. 7. As shown therein, upper and lower mounting members 130 are attached to an interior support member 62*a*–62*b* with a plurality of fasteners 64 which pass through apertures in the flat bases of the mounting members 130. The fasteners 64 could be nails, screws, or any other type of fastener capable of firmly attaching the flat base 138 of the mounting member 130 to the interior support member 62*a*–62*b*. The neck 136 of the mounting member 130 then protrudes through holes formed in an exterior wall 60 of the building. The ends of the necks 136 extend out away from the exterior wall 60.

An exterior cantilevered beam 90 is then attached to the mounting members 130, and to the interior support member 62*a*–62*b*, with lag bolts 140 or any other suitably shaped screw. The lag bolts 140 may include threads that cooperate with threads on interior bores of the mounting members 130. In addition, the threads on the lag bolts 140 may also screw into the interior support member 62*a*–62*b* to better attach the exterior cantilevered beam 90 to the building. A waterproofing material 67, such as caulk, is then placed in the holes in the exterior wall 60 around the necks 136 of the mounting members 130. The caulking 67 prevents water or moisture from passing into the building though the holes in the exterior wall 60.

Because the necks 136 of the mounting members 130 protrude out away from the exterior wall 60, the end of the cantilevered beam 90 is held away from the exterior wall 60.

As mentioned above, this helps to prevent the collection of water or moisture against the exterior wall 60. In addition, the mounting members 130 allow an exterior deck or balcony to be attached to the exterior wall of the building long after construction of the building has been finished. The mounting members 130 can be attached to the interior support member 62*a*–62*b* before the exterior wall 60 of the building is finished. After the mounting members 130 have been attached, the exterior wall 60 of the building can be formed around the necks 136 of the mounting members 130. The waterproofing material 66 can be inserted or applied around the necks of the mounting members to insure that a waterproof seal is maintained. Then, after the building has been finished, an exterior deck or balcony can be mounted by attaching the exterior cantilevered beam 90 to the mounting members using the lag bolts 140.

In the arrangement shown in FIGS. 2 and 3, the upper and lower bolts 74, 76 can be mounted to the first interior support member 62*a*–62*b* and the second interior support member 66 before the building is completed. Then, an exterior wall 60 can be formed around the upper and lower bolts 74, 76. Waterproofing caulk or other materials 66 can be placed in the holes of the exterior wall 60 to ensure that a waterproof seal is maintained. The protruding ends of the upper and lower bolts 74, 76 can then be left in place until such time as an exterior deck or balcony is to be mounted to the building.

In the embodiments described above, two bolts have been used to attach an exterior cantilevered beam to a building. However, in particular embodiments of the invention, only a single bolt can be used at the top of an exterior cantilevered beam, or more than two bolts can be used. Also, the number of nuts that are used with the bolts in an embodiment as shown in FIGS. 2 and 3 could be different.

Further, although the embodiment shown in FIG. 7 utilizes lag bolts 140 that penetrate both a mounting member 130 and portions of an interior support member, in other embodiments of the invention, the lag bolt may only extend into the mounting member 30. Further, in still other embodiments like the ones shown in FIG. 7, a bolt could pass completely through a mounting member 130 without interacting with interior threads on the mounting member, and then attach to an interior support member.

The foregoing embodiments are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures. For example, although a nail and a screw may not be structural equivalents in that a nail employs a cylindrical surface to secure parts together, whereas a screw employs a helical surface, in the environment of fastening parts, a nail and a screw may be equivalent structures.

What is claimed is:

1. A mount for attaching an exterior cantilevered beam to a building, comprising:

a first interior support member having a length axis that is arranged substantially parallel to an exterior wall of the building;

a second interior support member having a length axis arranged substantially perpendicular to the exterior wall of the building;

upper and lower bolts that pass through the exterior wall of the building and through the first interior support member, wherein exterior ends of the upper and lower bolts are configured to be attached to the exterior cantilevered beam; and a strap that is attached to the upper bolt and to the second interior support member.

2. The mount of claim 1, further comprising a plurality of nuts, wherein at least one nut is threaded onto each of the upper and lower bolts such that when an exterior cantilevered beam is attached to the upper and lower bolts, the exterior cantilevered beam will be held away from the exterior wall.

3. The mount of claim 2, further comprising first and second flanges, wherein the first flange is arranged between heads of the upper and lower bolts and a first side of the first interior support member, and wherein the second flange is arranged between a second side of the first interior support member and the exterior wall.

4. The mount of claim 3, wherein nuts are threaded onto the upper and lower bolts such that the nuts extend from the second flange, through the exterior wall.

5. The mount of claim 3, wherein nuts threaded onto the upper and lower bolts cause the first and second flanges to sandwich the first interior support member.

6. The mount of claim 1, wherein the second interior support member comprises an interior floor joist.

7. The mount of claim 1, wherein the second interior support member comprises a bridge member that is arranged between adjacent interior floor joists.

8. The mount of claim 1, wherein the strap is an L-shaped member having a first leg that is arranged adjacent the first interior support member and that is attached to the upper bolt, and wherein the L-shaped member has a second leg that is attached to the second interior support member.

9. The mount of claim 8, wherein the second leg of the L-shaped member is nailed to the second interior support member.

10. A method of creating a mount for attaching an exterior cantilevered beam to a building, comprising the steps of:

creating upper and lower holes that extend through an exterior wall of the building, and through a first interior support member that has a length axis arranged substantially parallel to the exterior wall;

attaching a strap to a second interior support member, wherein the second interior support member has a length axis that is arranged substantially perpendicular to the exterior wall;

passing an upper bolt through the upper hole, and through a hole in the strap;

passing a lower bolt through the lower hole; and threading a plurality of nuts onto the upper and lower bolts.

11. The method of claim 10, further comprising the steps of:

placing first and second flanges on opposite sides of the first interior support member such that when the plurality of nuts are threaded onto the upper and lower bolts, the first and second flanges sandwich the first interior support member.

12. The method of claim 10, wherein the threading step results in nuts extending along the upper and lower bolts through the exterior wall.

13. The method of claim 10, wherein the threading step results in nuts being located on the upper and lower bolts such that when an exterior cantilevered beam is attached to the upper and lower bolts, the exterior cantilevered beam will be held away from the exterior wall.

14. The method of claim 10, wherein the step of attaching a strap to a second interior support member comprises attaching an L-shaped strap such that a first leg of the L-shaped strap lies adjacent the first interior support member, and such that a second leg of the L-shaped strap lies adjacent the second interior support member.

15. The method of claim 14, wherein the step of attaching a strap to the second interior support member comprises nailing the second leg of the L-shaped strap to the second interior support member, and wherein the step of passing an upper bolt through a hole in the strap comprises passing the upper bolt through a hole in the first leg of the L-shaped strap.

16. The method of claim 10, further comprising a step of placing a waterproofing material in the upper and lower holes in the exterior wall, around the upper and lower bolts, to prevent water from penetrating the exterior wall of the building through the upper and lower holes.

17. A mount for attaching an exterior cantilevered beam to a building, comprising:

a mounting member having a flat base, a neck that extends from the flat base, and a substantially straight bore passing through the neck and the flat base, wherein the flat base of the mounting member is attached to an interior support member of a building such that the neck of the mounting member extends through a hole in an exterior wall of the building; and a screw that extends through the bore of the mounting member, and into the interior support member, wherein the screw is configured to attach an exterior cantilevered beam to the mounting member.

18. The mount of claim 17, wherein threads are formed along the bore of the mounting member, and wherein the screw has threads that mate with the threads on the bore.

19. The mount of claim 18, wherein the screw is configured such that the threads on the screw also attach the screw to the interior support member.

20. The mount of claim 17, wherein a plurality of holes pass through the flat base of the mounting member, and further comprising a plurality of fasteners configured to attach the mounting member to the interior support member, wherein each of the fasteners passes through one of the holes and into the interior support member.

21. The mount of claim 17, wherein the neck of the mounting member is configured such that when an exterior cantilevered beam is attached to the mounting member, the exterior cantilevered beam is held away from the exterior wall.

22. A method of forming a mount for attaching an exterior cantilevered beam to a building, comprising the steps of:

forming a hole through an exterior wall of the building;

attaching a mounting member having a flat base, a neck that extends from the flat base, and a substantially straight bore passing through the neck and the flat base to an interior-support member such that the neck of the mounting member extends through the hole in the exterior wall of the building; and providing a screw that is configured to pass through the bore of the mounting member and into the interior support member, wherein the screw is also configured to attach an exterior cantilevered beam to the mounting member.

23. The method of claim 22, wherein the attaching step comprises attaching the mounting member to the interior support member such that when an exterior cantilevered beam is attached to the mounting member, the exterior cantilevered beam will be held away from the exterior wall.

24. The method of claim 22, wherein the attaching step comprises attaching the mounting member to the interior support member such that the neck of the mounting member extends beyond the exterior wall.

25. The method of claim 22, wherein the attaching step comprises passing fasteners through holes formed in the base 'of the mounting member and into the interior support member to attach the mounting member to the interior support member.

26. The method of claim 22, further comprising a step of placing a waterproofing material in the hole in the exterior wall, around the neck of the mounting member, to prevent water from penetrating the exterior wall of the building through the hole.

* * * * *